US005938287A

United States Patent [19]

Donnelly

[11] Patent Number: 5,938,287

[45] Date of Patent: Aug. 17, 1999

[54] SEAT FOR ELDERLY AND DISABLED

[76] Inventor: Brian F. Donnelly, 1118 Salamanca Ct., Davis, Calif. 95610

[21] Appl. No.: 08/890,833

[22] Filed: Jul. 10, 1997

Related U.S. Application Data

[60] Provisional application No. 60/023,265, Jul. 11, 1996.

[51] Int. Cl.[6] ..... A47C 7/54

[52] U.S. Cl. ..... 297/411.42; 297/446.1

[58] Field of Search ..... 297/411.42, 445.1, 297/446.1, 411.4; D6/334, 379, 380, 500, 501

[56] References Cited

U.S. PATENT DOCUMENTS

| | | | |
|---|---|---|---|
| Re. 3,882 | 3/1870 | Chase | 297/411.42 |
| D. 9,887 | 4/1877 | Goodwin . | |
| D. 40,613 | 4/1910 | Waters, Jr. . | |
| 147,607 | 2/1874 | Chase | 297/411.24 |
| D. 180,134 | 4/1957 | Calder . | |
| D. 188,895 | 9/1960 | Joines . | |
| D. 193,506 | 9/1962 | Smith et al. . | |
| D. 223,025 | 2/1972 | Barecki et al. . | |
| D. 238,222 | 12/1975 | Eberle . | |
| D. 248,799 | 8/1978 | Adams . | |
| D. 289,347 | 4/1987 | Halme . | |
| D. 294,782 | 3/1988 | Balderi . | |
| D. 342,620 | 12/1993 | Tseng . | |
| D. 366,773 | 2/1996 | Yurk . | |
| D. 366,775 | 2/1996 | Kane . | |
| D. 378,965 | 4/1997 | Yurk . | |
| 1,170,669 | 2/1916 | Ridgely . | |
| 1,351,995 | 9/1920 | Cornish . | |
| 2,670,787 | 2/1954 | Vandas et al. . | |
| 2,834,404 | 5/1958 | Groome . | |
| 2,938,575 | 5/1960 | Molla | 297/411.42 |
| 3,077,364 | 2/1963 | Eppink . | |
| 3,144,272 | 8/1964 | Yadven . | |
| 3,336,077 | 8/1967 | Radke et al. . | |
| 3,635,521 | 1/1972 | Shivvers . | |
| 3,638,997 | 2/1972 | Shapiro et al. . | |
| 3,847,433 | 11/1974 | Acton et al. . | |
| 4,249,774 | 2/1981 | Andreasson . | |
| 4,555,139 | 11/1985 | Leib . | |
| 4,688,851 | 8/1987 | Whiteford . | |
| 4,690,459 | 9/1987 | Ullman . | |
| 4,778,217 | 10/1988 | Lane . | |
| 4,852,944 | 8/1989 | Hartmann . | |
| 5,292,177 | 3/1994 | Balderi et al. . | |
| 5,306,072 | 4/1994 | Caldwell . | |
| 5,309,583 | 5/1994 | White et al. . | |
| 5,342,111 | 8/1994 | Charles . | |
| 5,375,911 | 12/1994 | Morrow . | |

FOREIGN PATENT DOCUMENTS

| | | |
|---|---|---|
| 1115421 | 10/1961 | Germany . |

OTHER PUBLICATIONS

Patient Chairs, Health Chair, Model Nos. 1376, 1377, 1378, Thonet advertising brochure Carson's chair shown.

*Primary Examiner*—Peter R. Brown
*Attorney, Agent, or Firm*—Burns, Doane, Swecker & Mathis, L.L.P.

[57] ABSTRACT

A seat, such as in a chair or bench, for indoor or outdoor spaces that makes sitting and rising from a seated position easier, safer and more comfortable for the elderly or individuals with temporary or permanent disabilities. A seat with a unique extended arm configuration having a plurality of secure support surfaces extending beyond the front edge of the seating surface used in conjunction with a seating surface that can be higher than conventional seats and has a seating surface that can be parallel to horizontal or tilted slightly forward. When used in a free-standing mode the extended arms are used in conjunction with a front leg support that extends beyond the front edge of the seating surface. In a non-free standing mode the extended arms can be used without the front leg support. The unique arm configuration or combination of unique arm and front leg support configuration provide increased comfort and safety when leaning back to sit down or pushing up to rise from a seated position.

13 Claims, 10 Drawing Sheets

SEAT FOR ELDERLY AND DISABLED

This application claims the benefit of U.S. Provisional Application Ser. No. 60/023,265, filed Jul. 11, 1996 and incorporates the disclosure of that application in its entirety.

FIELD OF THE INVENTION

The present invention is directed to a seat for accommodating individuals who have a problem lowering into and rising from a seated position in conventional seats. The present invention is particularly directed to chairs and benches for accommodating the elderly and persons with disabilities including people who because of injury, arthritis or temporary circumstance, such as pregnancy, find it difficult to assume a fully seated position in conventional chairs and benches and then raise themselves up into a walking position.

BACKGROUND OF THE INVENTION

Research has shown that a growing segment of the population, primarily as a result of the aging process experience some difficulty in sitting and rising from a seated position when using traditional types of chairs and benches. With the passage of the Americans with Disabilities Act (ADA) and a growing national consciousness concerning accommodating the needs of the elderly and disabled, there is an ever increasing need for devices to address these needs. The number of people who are considered "elderly" is rapidly expanding as children of the "Baby Boom" era move into their fifties and sixties. In addition, research has shown that the number of people with permanent and temporary disabilities has been continually rising over the past decade.

Conventional seating in outdoor and indoor spaces has some limitations with respect to providing maximum comfort and ease of use for the growing populations of elderly and disabled.

SUMMARY OF THE INVENTION

The present invention overcomes the limitations of the prior art to provide seating, such as in a chair or bench, for outdoor or indoor spaces that makes sitting and rising from a seated position easier, safer and more comfortable. The present invention makes sitting and rising easier by virtue of a unique arm and front leg configuration that extend beyond the forward-most edge of a seating surface wherein the arm extends substantially the same distance as the front leg. The extended arm configuration provides a secure support when leaning back to sit down or pushing up to rise from a seated position. Users of the novel arm and leg configuration of the present invention lean forward at the pelvis and using the arms of the chair that extend beyond the front edge of the seat bottom push themselves up when rising. Conversely, when lowering themselves into the seat, the arms offer extra support and security without the user having to reach behind themselves to find the arm of the chair, thus reducing stress and risk of injury. In order to ensure that the seat remains stable at all times, the front legs of a free-standing seat extend beyond the front edge of the seating surface substantially the same distance as the extended arms to eliminate the risk of the seat tipping forward. In some embodiments, the function of the extended front legs can be accomplished by permanently securing the seat to the ground or to a wall surface instead of extending the leg forward of the seating surface. In addition, the seat can have a seating surface that is slightly higher than conventional seats and has a seating surface that is parallel to horizontal or angled forward relative to horizontal. Furthermore, the unique arm configuration can form a plurality of secure support surfaces wherein each support surface has a portion substantially parallel to horizontal.

In one aspect of the present invention, there is provided a seat supported by a rear support member and at least two front support members, the forward-most support point of the two front support members extending beyond the forward-most edge of the seating member, and an arm support having a forward-most point which extends beyond the forward-most edge of the seating member substantially the same distance as the forward-most support point of the two front support members.

In another aspect of the present invention, there is provided a seat supported by at least two side support members, the two side support members having their support points recessed behind the forward-most edge of the seating member and the support points being anchored to a non-movable support, and an arm support having a forward-most point which extends beyond the forward-most edge of the seating member, the arm support is configured to have an upper support surface and a lower support surface, the upper support surface and the lower support surface each having a portion which is substantially parallel to horizontal for assisting an individual in rising and lowering in the seat.

DETAILED DESCRIPTION OF THE PREFERRED EMBODIMENTS

Figure 12:
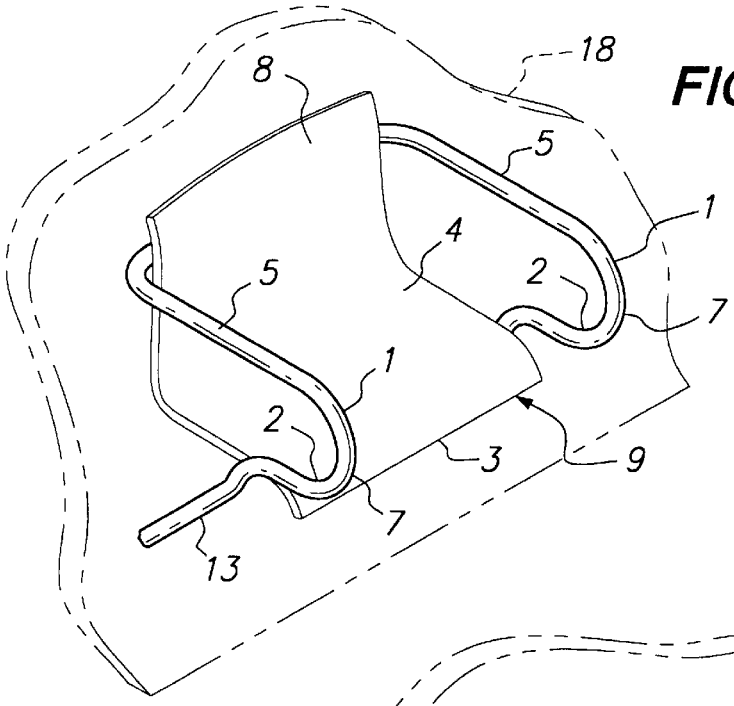
FIG. 12 is a perspective view of a wall mountable embodiment of the present invention.
Figure 13:
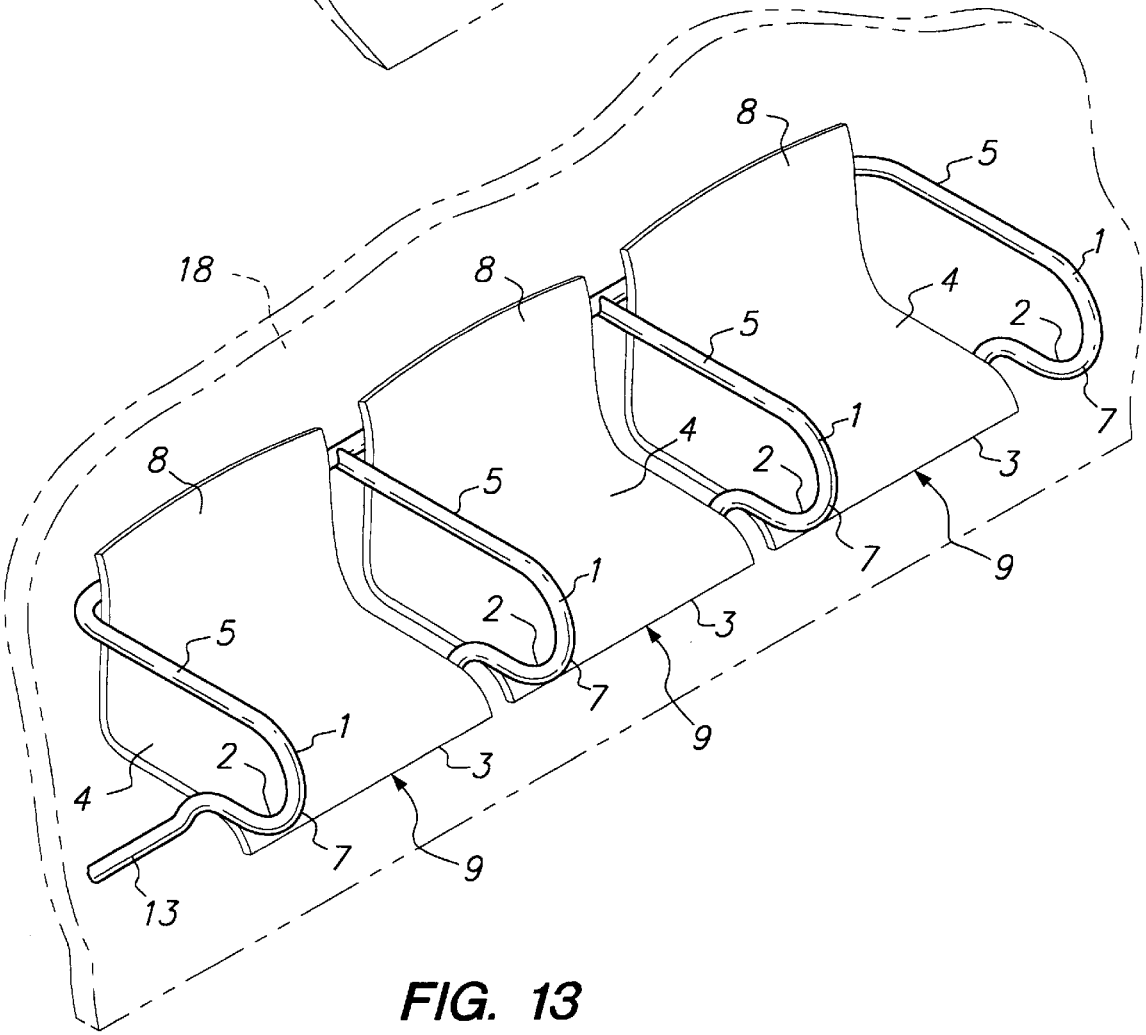
FIG. 13 is a perspective view of a yet another wall mountable embodiment of the present invention.
Figure 14:
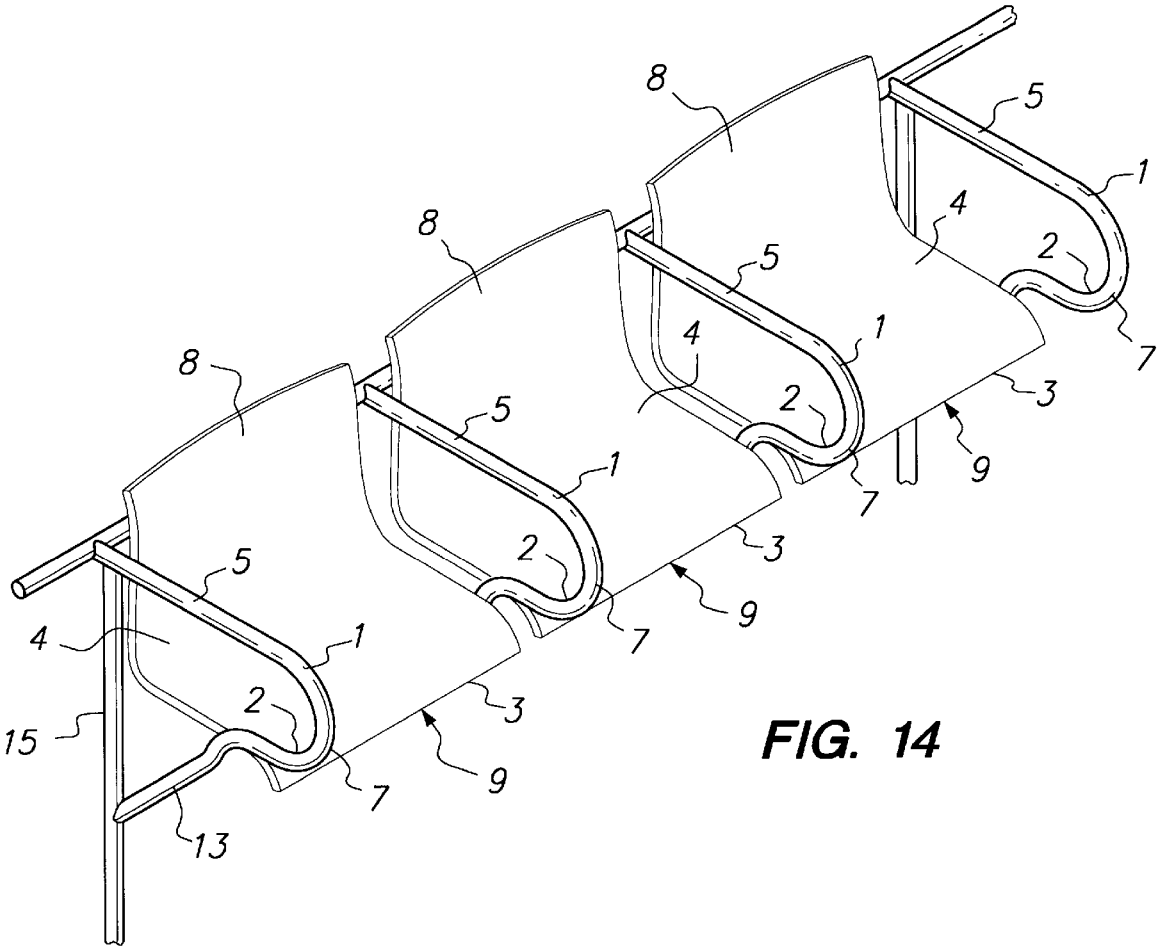
FIG. 14 is a perspective view of a rail mountable embodiment of the present invention.
Figure 15:
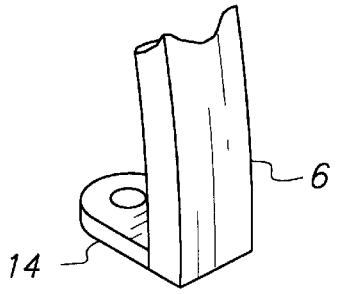
FIG. 15 is a detail of a flange for anchoring a seat to the ground in accordance with one embodiment of the present invention.

With continued reference to the drawings, seat 9 has a novel combination of features without any moving elements or complicated mechanical systems (i.e., the elements are non-articulating, fixed and stable) that make sitting and rising from a seated position easier and safer particularly for the elderly and people with permanent or temporary disabilities. The seat 9 of the present invention can be free-standing as depicted in FIGS. 1–8, or non-free standing as depicted in FIGS. 9–14. The seat of the present invention includes, but is not limited to, a chair, bench, couch, love seat, tandem seating, or a multiple seating surface fixture. The term "free-standing" generally means that the seat in either a single or multiple seating surface version does not need to be anchored to an item (such as, but not limited to, the floor, ground, wall, or rail) in order to remain stable without tipping forward or backward during the act of sitting and rising from a seated position. As can be seen in FIG. 15, the free-standing seats of FIGS. 1–8 can be anchored to a support surface with the flange 14 or some other member or device to prevent theft or movement of the seat 9 but the flange is not required to prevent tipping. The term "non-free standing" generally means that the seat in either a single or multiple seating surface version is securely attached to an item (such as, but not limited to, the floor, ground, wall, or rail). The non-free standing seat is securely attached to the item in any of a variety of ways such as, but not limited to, the use of flange plates 12 and bolts (FIG. 10), directly embedding the legs in concrete (FIGS. 11–13), welding (FIG. 14), or clamping. FIG. 12 is a non-free standing single seat wall mounted embodiment of the present invention in which the leg supports 13 are anchored to the wall 18. FIG. 13 is a non-free standing multiple seat wall mounted embodiment of the present invention. FIG. 14 is a non-free standing multiple seat embodiment of the present invention mounted on a railing 15 by welding the leg supports 13 and arm supports 5 to the railing 15.

Figure 9:
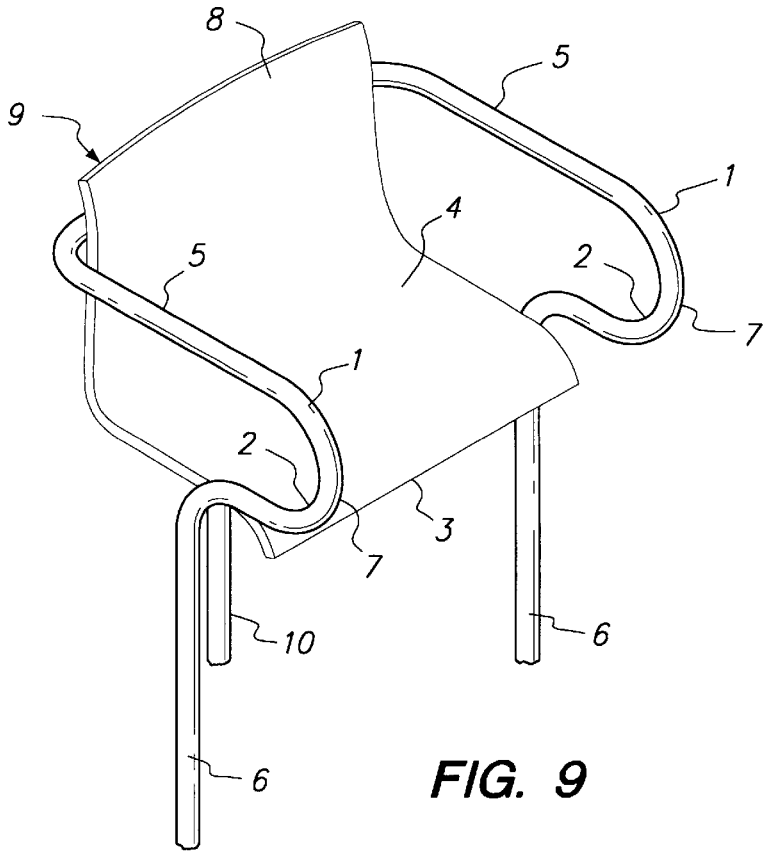
FIG. 9 is a perspective view of yet another embodiment of a seat in accordance with the present invention.
Figure 10:
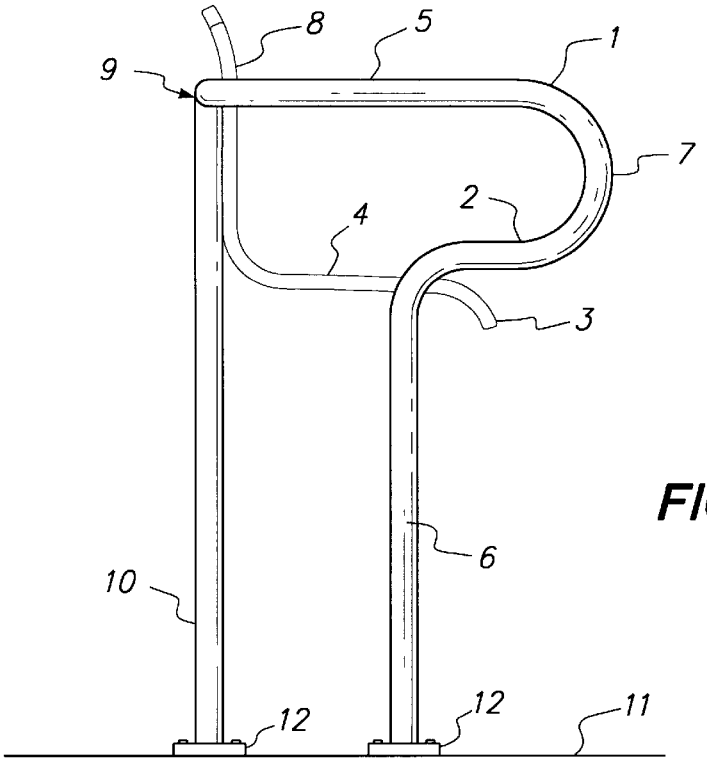
FIG. 10 is a left side elevational view of the seat of FIG. 9.
Figure 11:
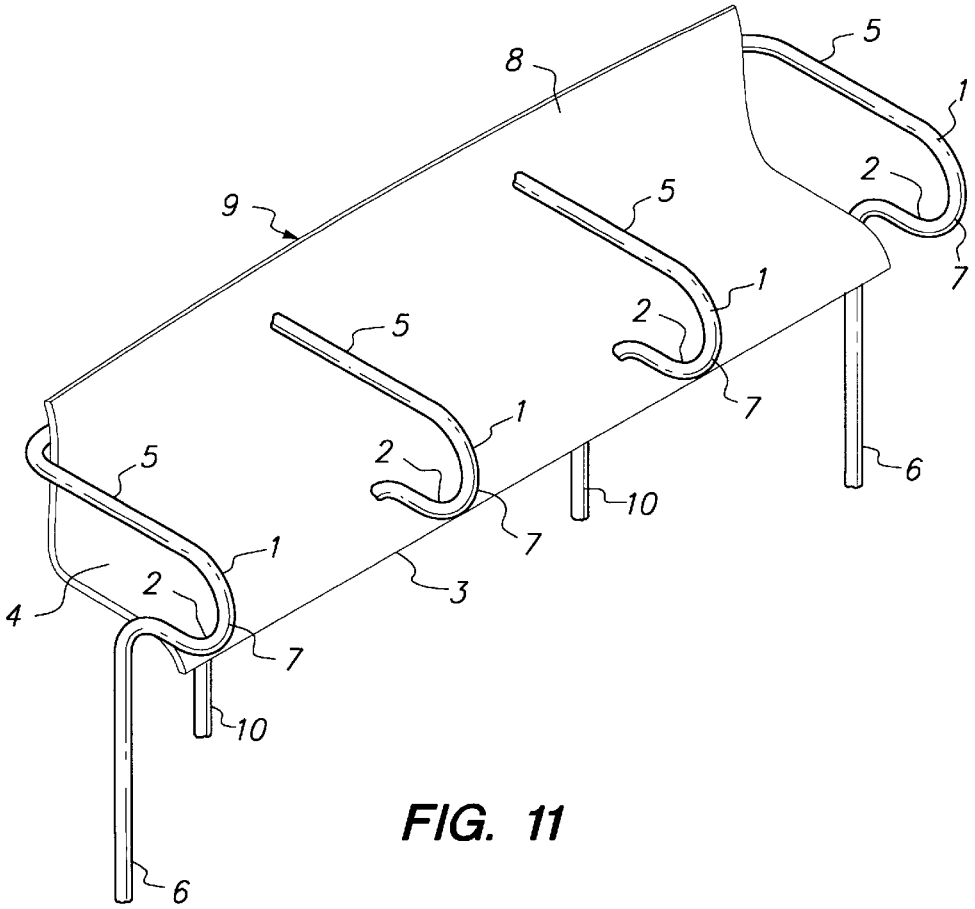
FIG. 11 is a perspective view of still another embodiment of a seat in accordance with the present invention.

The unique function of the seat 9 of any of the embodiments of the present invention is a result of several features with no moveable parts. In FIGS. 1–11, seat 9 is comprised of front supports or legs 6 and rear supports or legs 10 which support the seating surface 4 and seat back 8. Only one rear support 10 is shown in the embodiment of FIG. 9, thus as will be appreciated by one of ordinary skill in the art any number of front supports and/or rear supports can be used depending on the size and stability requirements of any particular embodiment. In FIGS. 12–14, leg supports 13 replace the front supports 6 and rear supports 10. Attached to or integrally formed with front support 6 and rear support (s) 10 (or leg supports 13) on each side of the seat 9 is an arm support 5. Preferably, there are two arm supports 5 for each portion of a seating surface area 4 designated generally for one individual. For example, there is an arm support 5 on each side of the seating surface 4 designated for one individual whether the seat 9 is a single seating surface seat as shown in FIGS. 1–6, 9, 10 and 12 or a multiple user, individual seating surface seat as shown in FIGS. 7, 11, 13 and 14 to provide greater assistance, comfort and security to a user. However, it is within the scope of the present invention that there be only one arm support 5 for a designated individual seating surface area 4 such as shown for the multiple user seating surface 19 of FIG. 8 or by providing an arm support on only one side of a single user seating surface seat.

Figure 1:
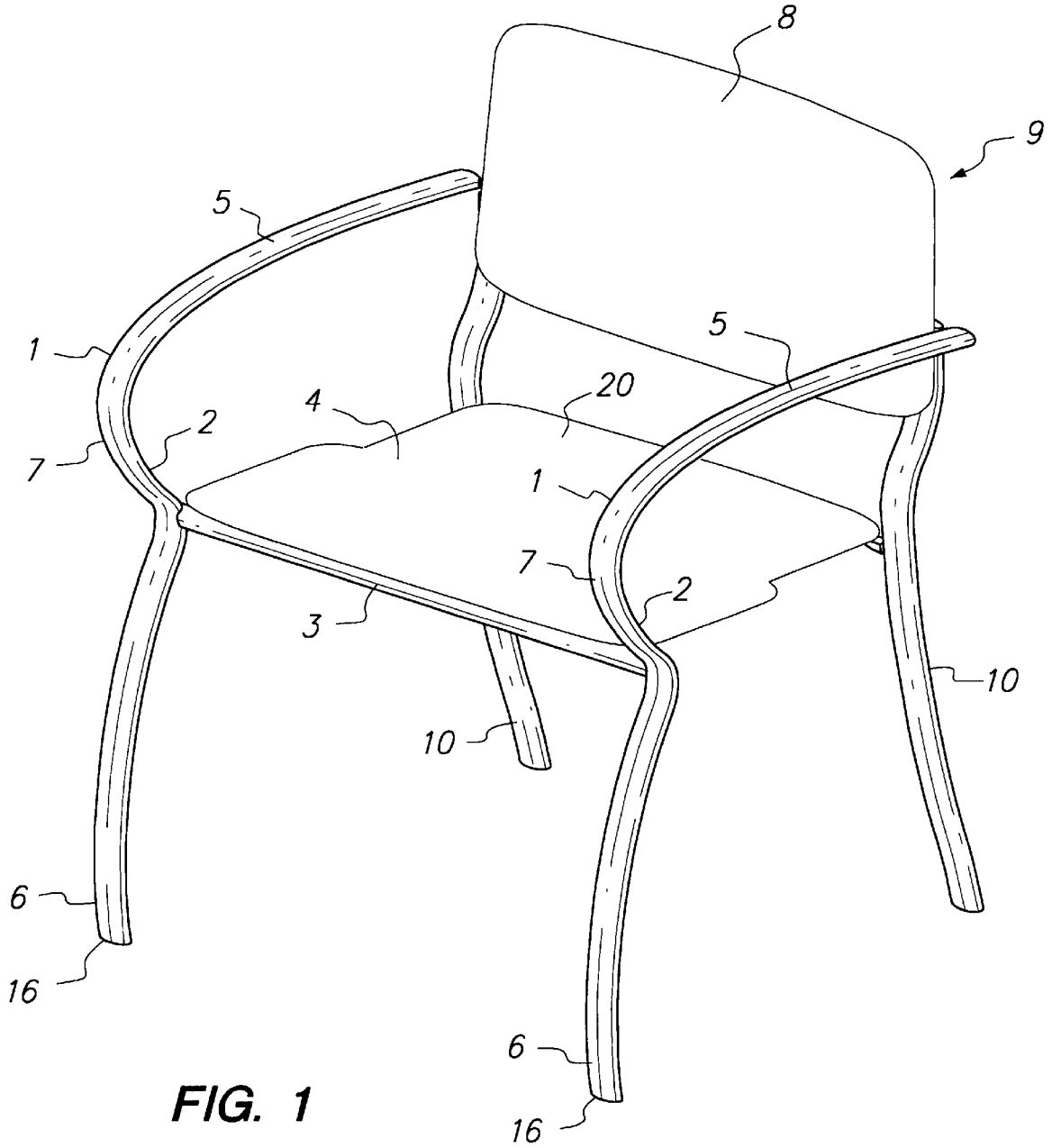
FIG. 1 is a perspective view of one embodiment of a seat in accordance with the present invention.
Figure 2:
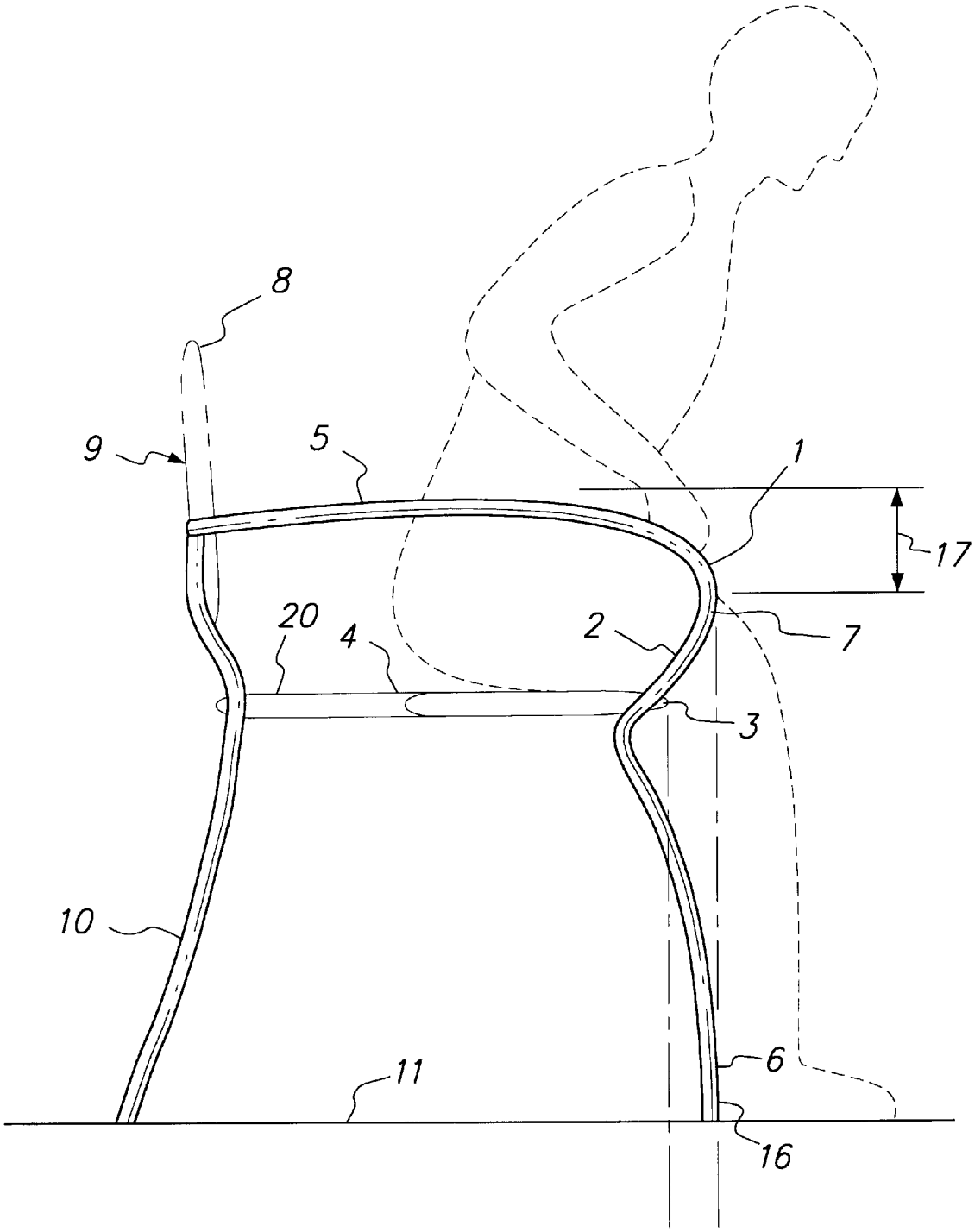
FIG. 2 is a left side elevational view of the seat of FIG. 1 with a user using the upper surface of the arm of the seat and the extended front leg as a way of safely rising from a seated position.
Figure 3:
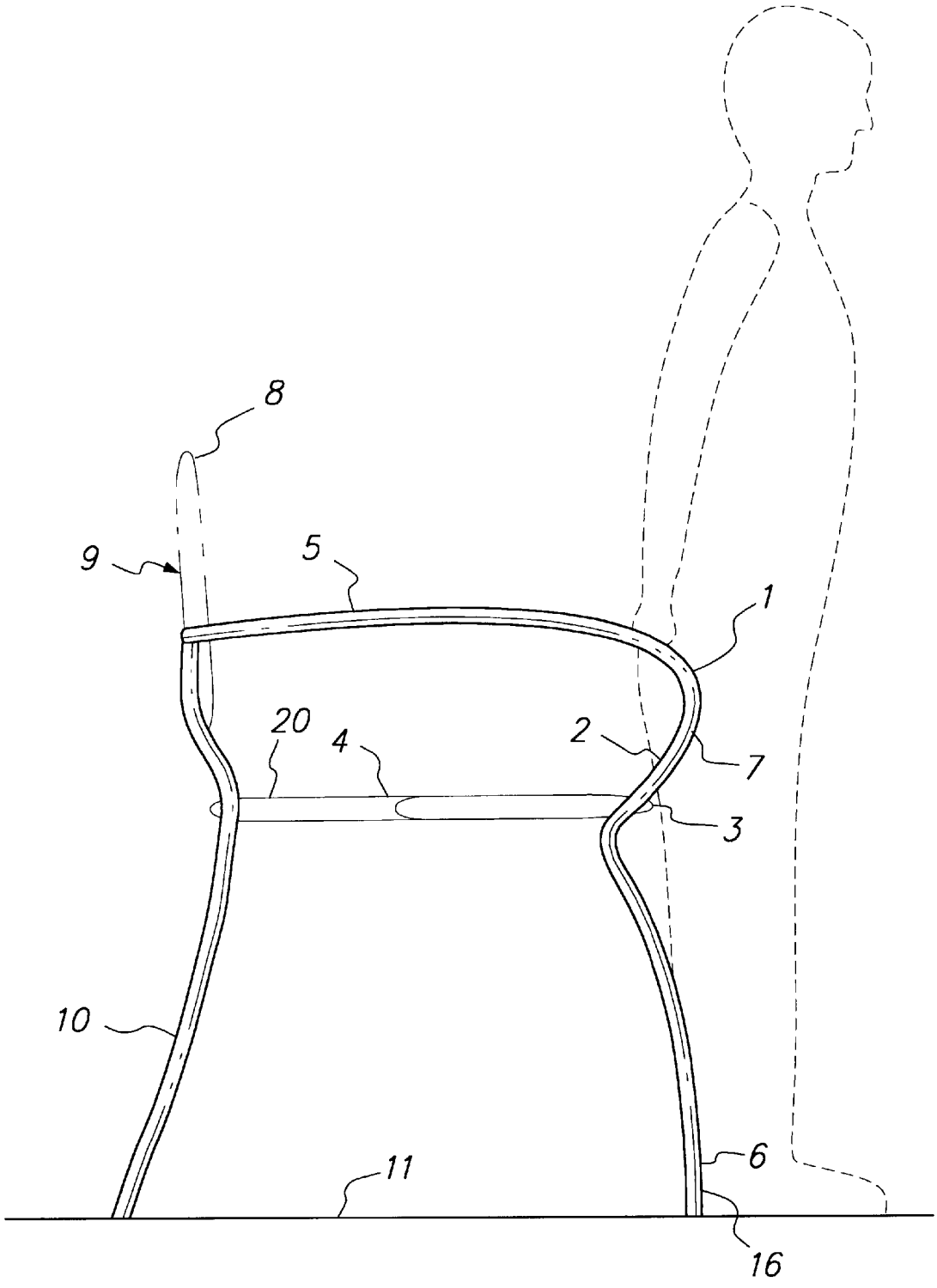
FIG. 3 is a left side elevational view of the seat of FIG. 1 with a user using an upper surface of the arm of the seat and the extended front leg as a way of safely lowering into a seated position.
Figure 4:
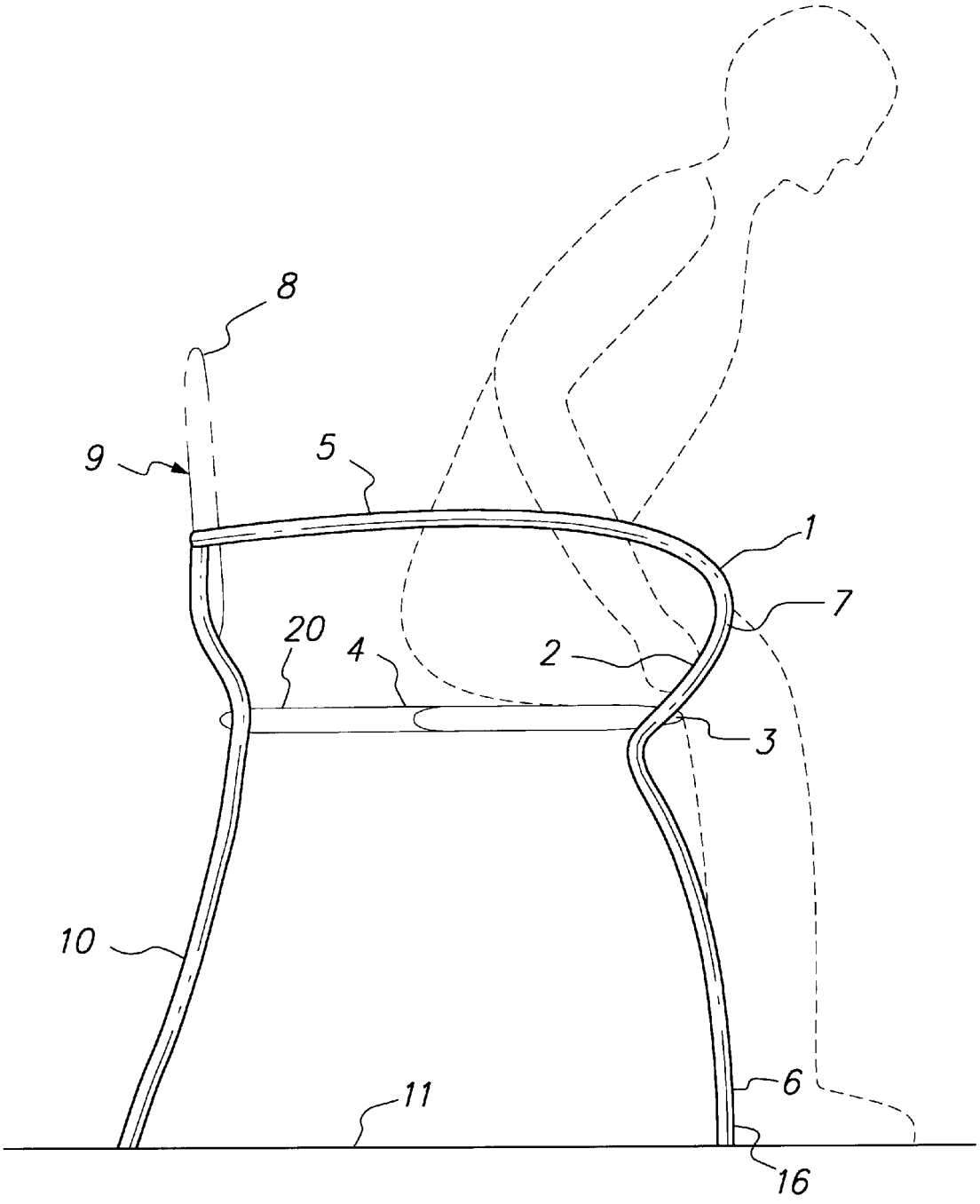
FIG. 4 is a left side elevational view of the seat of FIG. 1 with a user using a lower inner surface of the arm and the extended front leg to raise up from a seated position.

Extended arm support 5 is configured to provide a secure support surface in front of the seating surface 4 when a user is leaning back to sit down or pushing up to rise from a seated position. As best seen in FIGS. 2–4 and 10, the unique arm support configuration provides alternative support areas (e.g., an upper and a lower support surface) to assist people of varying heights and physical abilities. The arm support 5 extends substantially parallel to horizontal from an area adjacent to the seat back 8 to a position beyond the front edge 3 of the seating surface 4 providing an upper support surface 1 and curves down and back substantially parallel to horizontal to form a lower support surface 2. The forward-most point 7 of the arm support 5 extends forward beyond the front edge 3 of the seat surface 4 at a distance ranging between about 0.5 inches to about 8 inches, more preferably in the range of about 1.5 inches to about 6 inches, most preferably in the range of about 2.5 inches to about 4.5 inches. Each of the upper support surface 1 and the lower support surface 2 provide support out in front of the front edge of the seating surface 4 to aid during the process of lowering onto and/or rising out of the seated position. With the arm support 5 extended out in front of the seating surface front edge 3, the user can back up to the seat 9 such that the back of their legs contact the front edge 3 and they are able to grasp the arm support 5 without reaching behind them and outside of their field of view and without squatting, stooping and/or bending. The forward-most point 7 of the arm support 5 is closer to (in height relative to horizontal) the top of the arm support 5 than to the top surface of the seating surface 4. In the embodiment of FIGS. 1 and 2, preferably the dimension 17, which is the distance from the top of the arm support 5 to the forward-most point 7, is in the range of about 1.5 inches to about 4.5 inches, preferably about 2.5 inches to about 3.75 inches, more preferably about 3.5 inches which provides a relatively high forward upper support surface and a relatively high lower support surface for the user such that the user does not have to squat or stoop to be able to firmly grasp either support surface. Likewise, the vertical distance between the top surface of the seating surface 4 at the center of the seating surface and the upper arm support surface 5 is preferably in the range of about 6 inches to 11 inches, more preferably in the range of about 8 inches to 9 inches. It will be appreciated by one of ordinary skill in the art, that the upper support surface 1 and the lower support surface 2 of the arm support 5 do not have to be connected by a curved section or be curved at all. It is within the scope of the present invention, that the upper and lower support surfaces be connected in different shaped configurations or that the upper and lower support surfaces be separate supports that are not connected.

In the free-standing seat (for example depicted in FIGS. 1–8) the forward-most edge 16 of the front support 6 extends forward beyond the front edge 3 of the seating surface 4 at a distance equal to or slightly less than that of the forward-most point 7 of the support arm 5 in order to provide maximum stability when a person is sitting or rising from a seated position. The preferred relationship is to have the forward-most edge 16 of the front support 6 extend a distance that is substantially equal to the forward-most point 7 of the arm support 5. In this way, the user remains safe when reaching back and lowering into the seated position and also when leaning forward and rising because they have a well supported surface that extends beyond the front edge of the seat without having the possibility of the seat tipping forward. It is within the scope of the invention that the forward-most point 7 may extend beyond the forward-most edge 16 up to about 1 inch without there being a risk of tipping. Therefore, the expression that the forward-most point 7 extends substantially the same distance as the forward-most point 16 beyond the front edge 3 of the seating surface 4 means that the forward-most point 7 extends an equal distance as forward-most point 16 or up to about 1 inch farther than forward-most point 16. The unique combination of an extended support arm 5 and extended front support 6 enables the seat 9 to be free-standing without risk of tipping while reducing stress and increasing safety for users and caregivers who under normal conditions using conventional seats often are required to provide assistance by holding a user's arms and lowering them into a seated position or pulling them up from a seated position.

In addition to the extended arms 5, the seating surface 4 is parallel to the surface 11 or pitched forward slightly (i.e., the height of the seating surface 4 at the rear portion 20 adjacent to the seat back 8 is higher above the surface 11 than the front edge 3 of the seating surface 4) at an angle ranging between 0 degrees to about 4 degrees, more preferably about 1 degree to about 4 degrees, most preferably 1 degree, from horizontal. The depth of the seating surface 5 from the front edge 3 to the intersection with the seat back 8 is preferably in the range of about 13 inches to about 19 inches, more preferably in the range of about 16 to about 18 inches.

In any of the embodiments of the present invention, the seating surface 4 can be located higher off the surface 11 (FIG. 2) upon which a user stands prior to sitting than conventional chairs or benches. The seating surface of a conventional general purpose chair is generally 15 to 18 inches above the surface which the user stands prior to sitting, a conventional office chair is generally 14 to 19 inches, a conventional bar stool is 27 to 33 inches, and a conventional outdoor bench is 13 to 18 inches.

The height of the seating surface 4 is defined by measuring the perpendicular distance from the surface 11 upon which a user is standing prior to sitting to the top of the seating surface 4 at the front edge 3 of the seating surface 4. Preferably, the seating surface height to that point is in the range of about 17 inches to about 22 inches, more preferably the seating surface height is about 18 inches to 21.5 inches, most preferably 18 inches. A height adjustment mechanism can be incorporated into the legs of the seat to allow for adjustment in the height of the seating surface 4. The higher seating height in accordance with the present invention allows an average height elderly or disabled user to rest in the seat without having to bring their thighs parallel to or at an angle beyond parallel (i.e., a position wherein the user's knees are higher than their buttocks). In addition, the user's feet remain flat or generally close to flat relative to the surface 11. In this way, less effort is exerted in rising from the seated position and less stress and anxiety is experienced in "falling back" into the seat (as is often experienced with conventional chairs or benches).

The height of each embodiment of the seat of the present invention is generally determined based on the percentile rating relative to knee height for females 64–75 years old. For example, the height of the seating surface for a general purpose chair, office chair or outdoor bench for the 10th to 40th percentile is about 17 to 18 inches, for the 40th to 70th percentile is about 18 to 19 inches, for the 70th to 95th percentile is about 19 to 20 inches and for the 99th percentile is about 20 to 21 inches.

Figure 5:
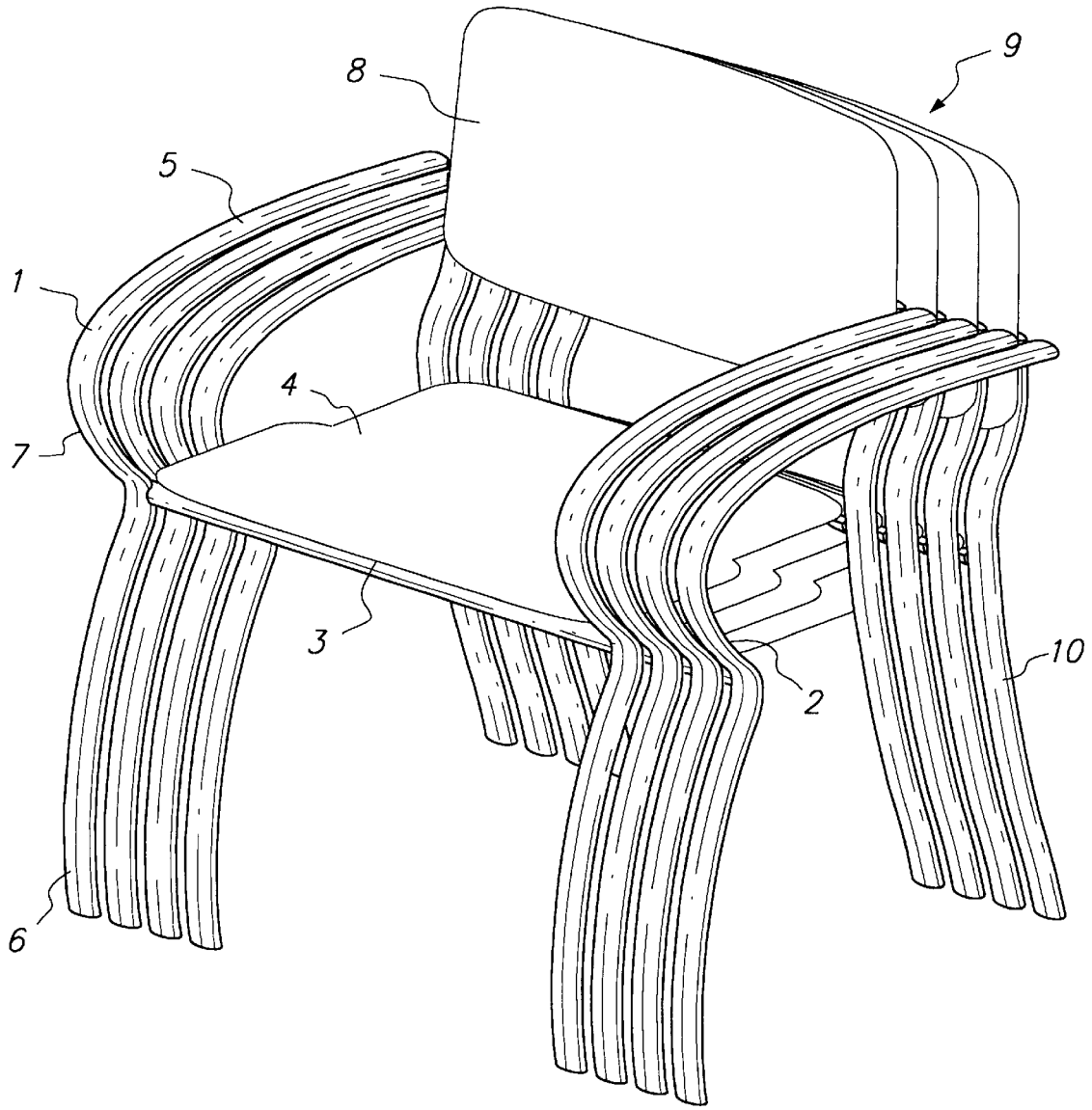
FIG. 5 is a perspective view of a plurality of seats in a stacked configuration.
Figure 6:
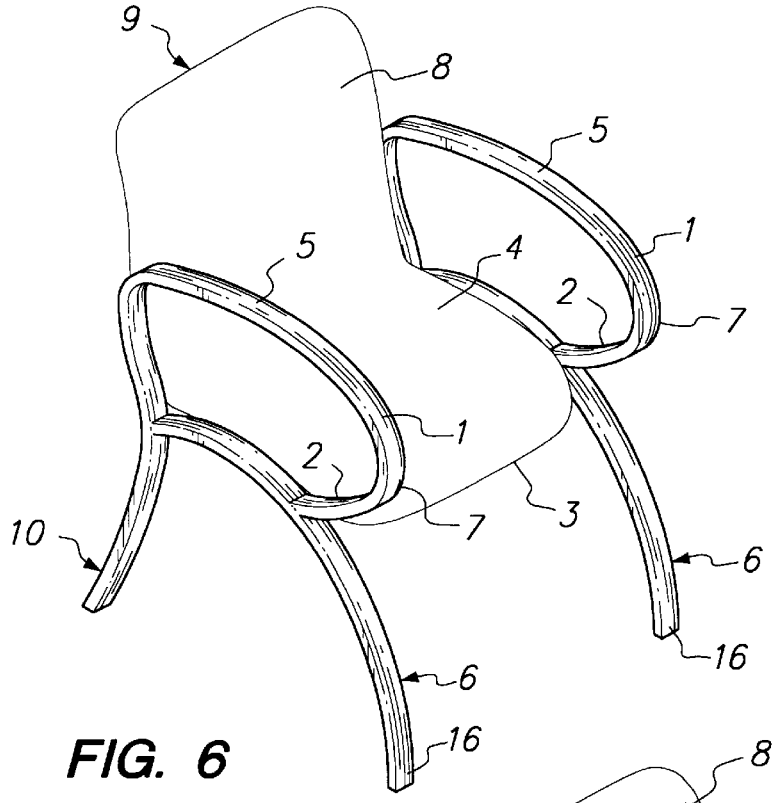
FIG. 6 is a perspective view of yet another embodiment of a seat in accordance with the present invention.
Figure 7:
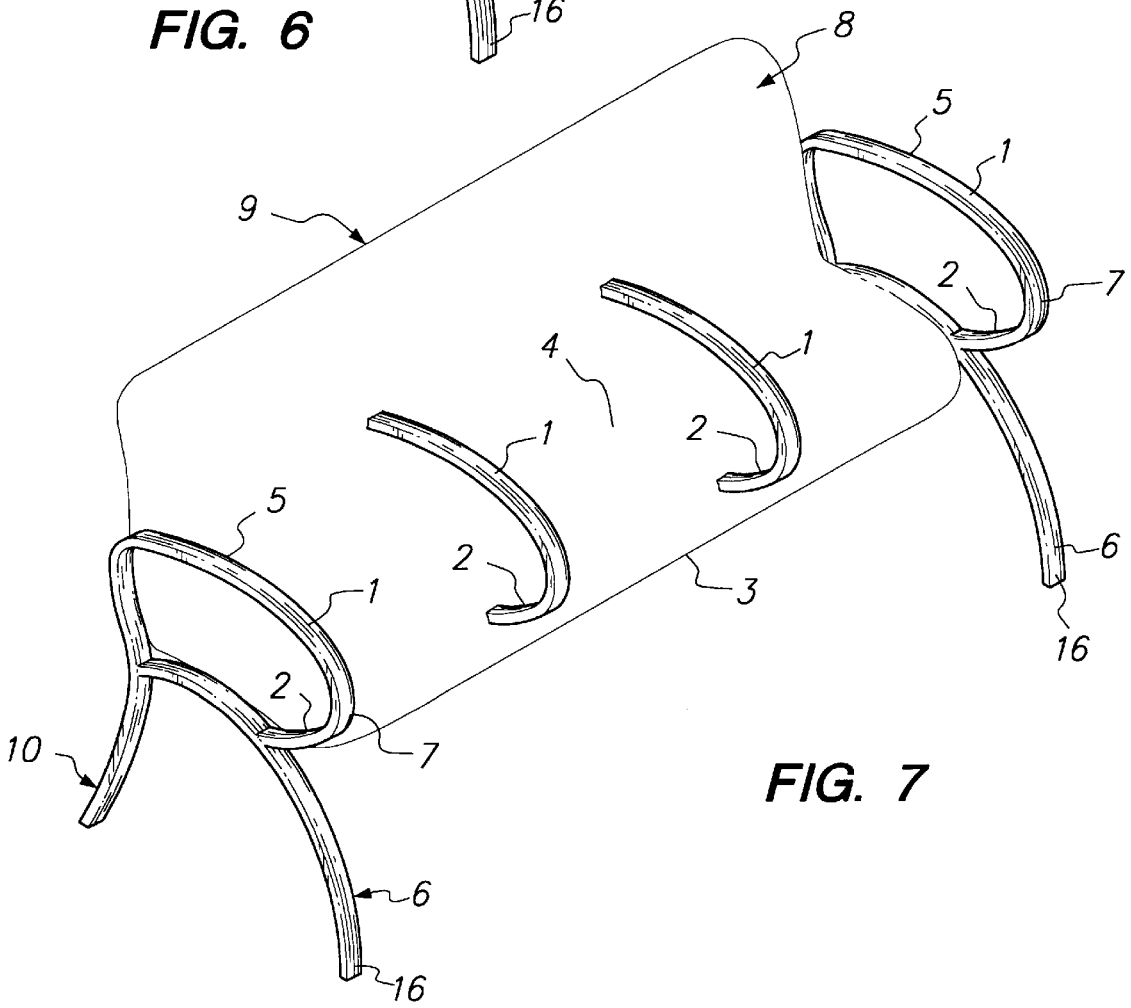
FIG. 7 is a perspective view of still another embodiment of a seat in accordance with the present invention.
Figure 8:
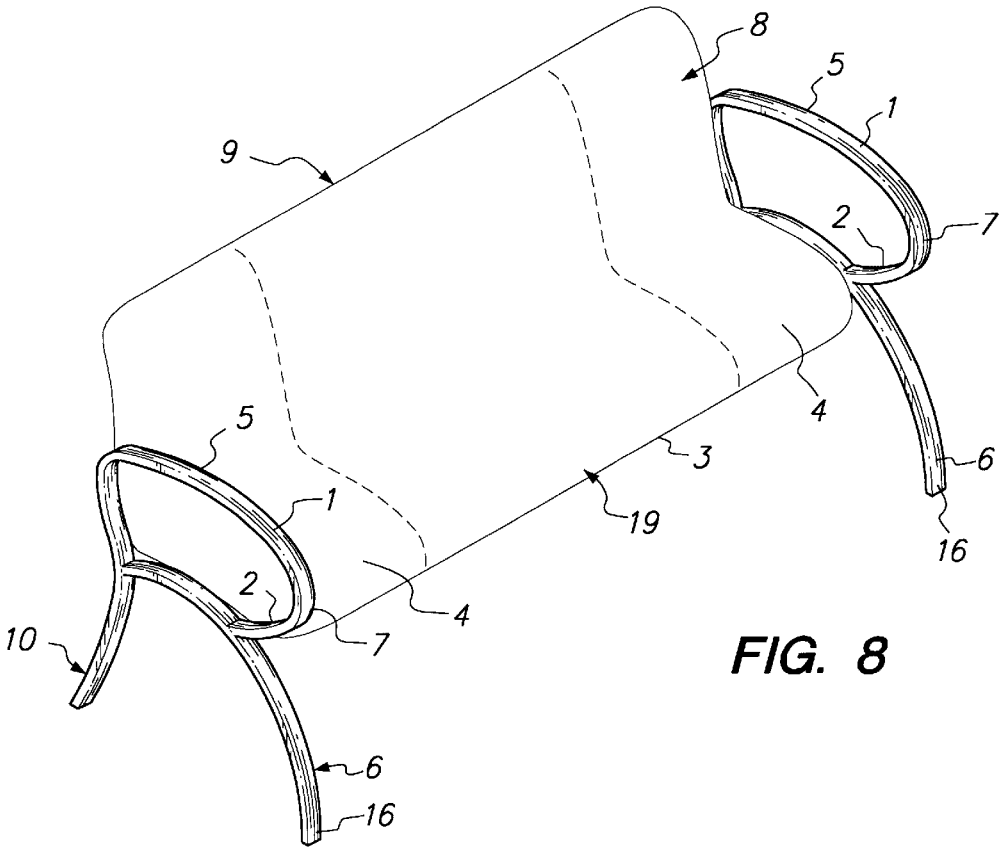
FIG. 8 is a perspective view of yet still another embodiment of a seat in accordance with the present invention.

As can be seen in FIG. 5, one embodiment of the free-standing seat 9 is stackable. The seat 9 is formed as a stacking unit by offsetting the rear leg support 10 inward from the integrated arm support 5 and front support 6 and reducing the width of the seating surface 4 in the rearward area 20 of the seating surface 4. The special shape of the integrated arm support 5 and front support 6 and their being located at a greater width than the rear supports 10 allow successive integrated arm supports 5 and front supports 6 to nest on top of one another to permit stacking of a plurality of seats 9.

The seat of the present invention can be constructed in a variety of ways, such as but not limited to comprising a frame that can be constructed out of bent and fabricated metal tubing having, but not limited to, a rectangular, cylindrical, circular, or elliptical cross-section. Likewise, the frame can be fabricated out of, but not limited to, solid wrought stock, wood, or plastic. In some embodiments, the two side frame structures serve as supports for the seat bottom and back without any cross-members. The seat bottom and back can be formed out of many types of materials such as, but not limited to, wood, wood slats, wire mesh, perforated sheet metal, molded plastic, or plastic fabric mesh material. The seat bottom and seat back can also be upholstered for use in interior and exterior applications with a variety of upholstery coverings that include fabric and easy to clean plastic materials. Similarly, the seat bottom and seat back can be formed as one continuous piece or exist as two or more separate parts.

Modifications and variations of the present invention will be apparent to those having ordinary skill in the art having read the above teachings, and the present invention is thus limited only by the spirit and scope of the following claims.

I claim:

1. A seat comprising:

a seating member having a forward-most edge;

a seat back;

at least one rear support member supporting the seating member and the seat back;

two front support members connected to the seat back and to the seat, the two front support members each having a horizontal arm portion, a curved portion, and a leg portion, the horizontal arm portions extending substantially horizontally from the seat back to the curved portions, the curved portions extending from the horizontal arm portions to the seat and having a continuous curve in a single direction, the leg portions extending from the curved portions and having a continuous forwardly bowed curve in a single direction, a forward-most portion of the curved portion and a forward-most portion of the leg portions extending beyond the forward-most edge of the seat by substantially the same distance.

2. The seat of claim 1 wherein the forward-most point of the curved portion extends beyond the forward-most edge of the seating member a distance in the range of about 0.5 inches to about 8 inches.

3. The seat of claim 1 wherein the forward-most point of the curved portion extends beyond the forward-most edge of the seating member a distance in the range of about 1.5 inches to about 6 inches.

4. The seat of claim 1 wherein the forward-most point of the curved portion extends beyond the forward-most edge of the seating member a distance in the range of about 2.5 inches to about 4.5 inches.

5. The seat of claim 1 wherein the two front support members provide an upper support surface along the horizontal arm portion and the curved portion for an individual to grasp when rising and lowering in the seat, and the two front support members provide a lower support surface on the curved portion adjacent the seat for an individual to grasp when rising and lowering in the seat.

6. The seat of claim 5 wherein the forward-most portion of the curved portion is located above a midpoint between a center of the seating member and the horizontal arm portion to provide a relatively high upper support surface and a relatively high lower support surface.

7. The seat of claim 6 wherein the seat is stackable in a manner such that the seating member, seat back, rear support member, and front support members of a first seat are adjacent the corresponding members of a second seat.

8. The seat of claim 6 wherein the forward-most point of the curved portion is in the range of about 1.5 inches to about 4.5 inches in vertical distance from the horizontal portion.

9. The seat of claim 6 wherein the forward-most point of the curved portion is in the range of about 2.5 inches to about 3.75 inches in vertical distance from the horizontal portion.

10. The seat of claim 6 wherein the forward-most point of the curved portion is about 3.5 inches in vertical distance from the horizontal portion.

11. The seat of claim 1 wherein the seating member is parallel to horizontal.

12. The seat of claim 1 wherein the seating member is slanted downward and forward with respect to horizontal.

13. The seat of claim 1 wherein the seating member, the rear support member and the front support members are configured such that the seat is stackable in a nesting configuration.

* * * * *